US006230986B1

(12) United States Patent
Vacher et al.

(10) Patent No.: US 6,230,986 B1
(45) Date of Patent: May 15, 2001

(54) SPRAY HEAD FOR PAINT AND SIMILAR SUBSTANCES

(75) Inventors: Eric Vacher, Bourg les Valence; Michel Chatron, Etoile, both of (FR)

(73) Assignee: ITW Surfaces and Finitions, Valence (FR)

( * ) Notice: Subject to any disclaimer, the term of this patent is extended or adjusted under 35 U.S.C. 154(b) by 0 days.

(21) Appl. No.: 09/479,890

(22) Filed: Jan. 10, 2000

(30) Foreign Application Priority Data

Jan. 11, 1999 (FR) ..... 99 00179

(51) Int. Cl.[7] ..... B05B 1/28
(52) U.S. Cl. ..... 239/297; 239/300
(58) Field of Search ..... 239/290, 300, 239/311, 318, 340, 375, 390, 391, 397, 407–411, 417.3, 417.5, 434.5, 525, 526, 530, 600, 296, 297

(56) References Cited

U.S. PATENT DOCUMENTS

| | | | | |
|---|---|---|---|---|
| Re. 19,907 | | 3/1936 | Krautzberger | 239/300 |
| 1,655,254 | * | 1/1928 | Binks | 239/290 |
| 2,544,123 | * | 3/1951 | Anderson | 239/290 |
| 2,743,963 | * | 5/1956 | Peeps | 239/300 |
| 3,096,023 | * | 7/1963 | Thomas | 239/300 |
| 3,332,623 | * | 7/1967 | Gallant | 239/290 |
| 4,744,518 | * | 5/1988 | Toth | 239/297 |
| 4,899,938 | | 2/1990 | Havrilla, Jr. | 239/294 |
| 5,421,518 | | 6/1995 | Robisch et al. | 239/311 |

* cited by examiner

*Primary Examiner*—David A. Scherbel
*Assistant Examiner*—Jorge Bocanegra
(74) *Attorney, Agent, or Firm*—Lowe Hauptman Gilman & Berner, LLP

(57) ABSTRACT

A spray head, in particular for a spray gun. In the invention, the spray nozzle (3) is guided and kept in place in the deflecting bush (4) and the said nozzle (3) and body (1) are mutually sealed by an inserted seal (2). The blow cap-piece (5) is detachably mounted on said deflecting bush (4).

12 Claims, 2 Drawing Sheets

SPRAY HEAD FOR PAINT AND SIMILAR SUBSTANCES

FIELD OF THE INVENTION

The present invention relates to sprayers for paints, lacquers etc and move automatically to spraying guns.

BACKGROUND OF THE INVENTION

It is known that such guns, whether automatic or manual, comprise a spray head to which is fed the spray substance and a pressurized propellant gas, which foremost is compressed air. Such a spray head consists of an assembly of parts cooperating in spraying and which mainly are the following:

- a spray nozzle,
- a needle translatable to open or close the orifice of the spray nozzle,
- a gas-blowing cap-piece, and
- a gas distributing bush, generally called the deflecting bush, allowing propellant gas to feed to the cap-piece and optionally to distribute the gas in a circular or flat jet of spray substance.

In the known guns, the nozzle is affixed on the gun body and as a result its disassembly is fairly complex. Intrinsically, however, the user must often handle the nozzle to clean it or replace it. Moreover, as regards these known guns, by the very affixation of the nozzle on the gun body, the path of the spray substance cannot be smooth and makes cleaning more difficult.

SUMMARY OF THE INVENTION

The objective of the present invention is to remedy the above-identified drawback and relates to a spray head wherein said nozzle is easily disassembled while also providing a smooth path of the spray substance in the region of the nozzle is assured.

For that purpose, the spray head of the invention used with a sprayer for a substance such as paint or lacquer, comprises a body on which are mounted the following:

A tubular spray nozzle fed with a spray substance from a conduit in the body and fitted at one of its ends with a spraying orifice which shall be opened or closed by a displaceable needle, a gas blowing cap-piece, and a gas distributing bush fed with pressurized gas from at least one conduit in the body and allowing to homogeneously feed the cap-piece with propellant gas and optionally to distribute the gas in a manner to vary the cross-section of the jet generated at the exit of said spraying orifice. This spray head is characterized in that the body comprises a planar surface wherein issues the conduit feeding the substance to be sprayed, the nozzle comprises a planar annular surface on the side opposite the spraying orifice.

A seal is inserted between the annular nozzle surface and the free end of the conduit feeding the spray substance.

The gas distributing bush comprises a planar end surface, and is able to guide and keep in place the nozzle.

A clamping mechanism is used to simultaneously mutually compress the planar end surface of the distribution bush and the planar surface of the body and press the seal between the planar annular surface of the nozzle and the free end of the conduit feeding the spray substance, In this manner the nozzle is kept pressed between the distribution bush and the body of the spray head of the invention and is easily disassembled by operating the clamping mechianism. Moreover the path of the substance between the conduit for the spray substance, the seal and the nozzle, is free from roughness and therefore can be smooth. Lastly, because there is no intermediate seal between the distribution bush and the body, assembly and disassembly of the spray head are especially well simplified.

In an advantageous embodiment mode of the invention, the spray head is characterized in that the planar surface of the body is fitted with a tubular stub wherein the spray substance issues from the feed conduit, the free annular end of the stub being planar and parallel to the planar surface of the body and constituting the free end of the conduit feeding the spray substance.

The gas distributing bush comprises a Continuous central orifice wherein the nozzle is guided and kept in place and thanks to which the distribution bush may be affixed on the tubular stub. Accordingly, the tubular stub acts to center the distribution bush relative to the body of the spray head.

Moreover, in a special embodiment, the clamping mechanism is implemented in a simple manner due to cooperating threads on the tubular stub and in the central orifice of the distribution bush.

In such an embodiment, the feed of a spray substance and of propellant gas from the body can be carried out in such manner that the gas feed conduit issues into a circular recess in the planar body surface, the recess being concentric with the tubular stub. The end surface of the gas distribution bush is fitted with a circular duct concentric with the central orifice, and the circular recesses of the body and the duct of the distribution bush communicate with each other when the planar body surface and the planar end surface of the distribution bush are compressed against each other.

It is furthermore known with respect to conventional guns that the air cap-piece in general is screwed onto the spray head. Intrinsically; however, the air cap-piece is subject to frequent operator intervention either to orient the jet of paint or to replace the air cap-piece. Consequently, the affixation system of the air cap-piece on the gun is vulnerable and its destruction or change inevitably entails replacement of the spray head or all of the body, that is it entails costly intervention.

To remedy this drawback, the present invention mounts the gas-blowing cap-piece in detachable but firm manner on the gas distributing bush.

Accordingly, the present invention uses the gas distributing bush simultaneously to affix the nozzle and to affix the gas blowing cap-piece.

Preferably, the gas blowing cap-piece is mounted on the distribution bush by a nut cooperating with a thread on the outside periphery of the bush.

The spray head of the present invention may be integral with the sprayer and in a design variation, the spray head may also be mounted on the sprayer.

BRIEF DESCRIPTION OF THE DRAWINGS

The Figures of the attached drawing elucidate the invention. Identical references in these Figures denote similar components.

BEST MODE FOR CARRYING OUT THE INVENTION

Figure 1:
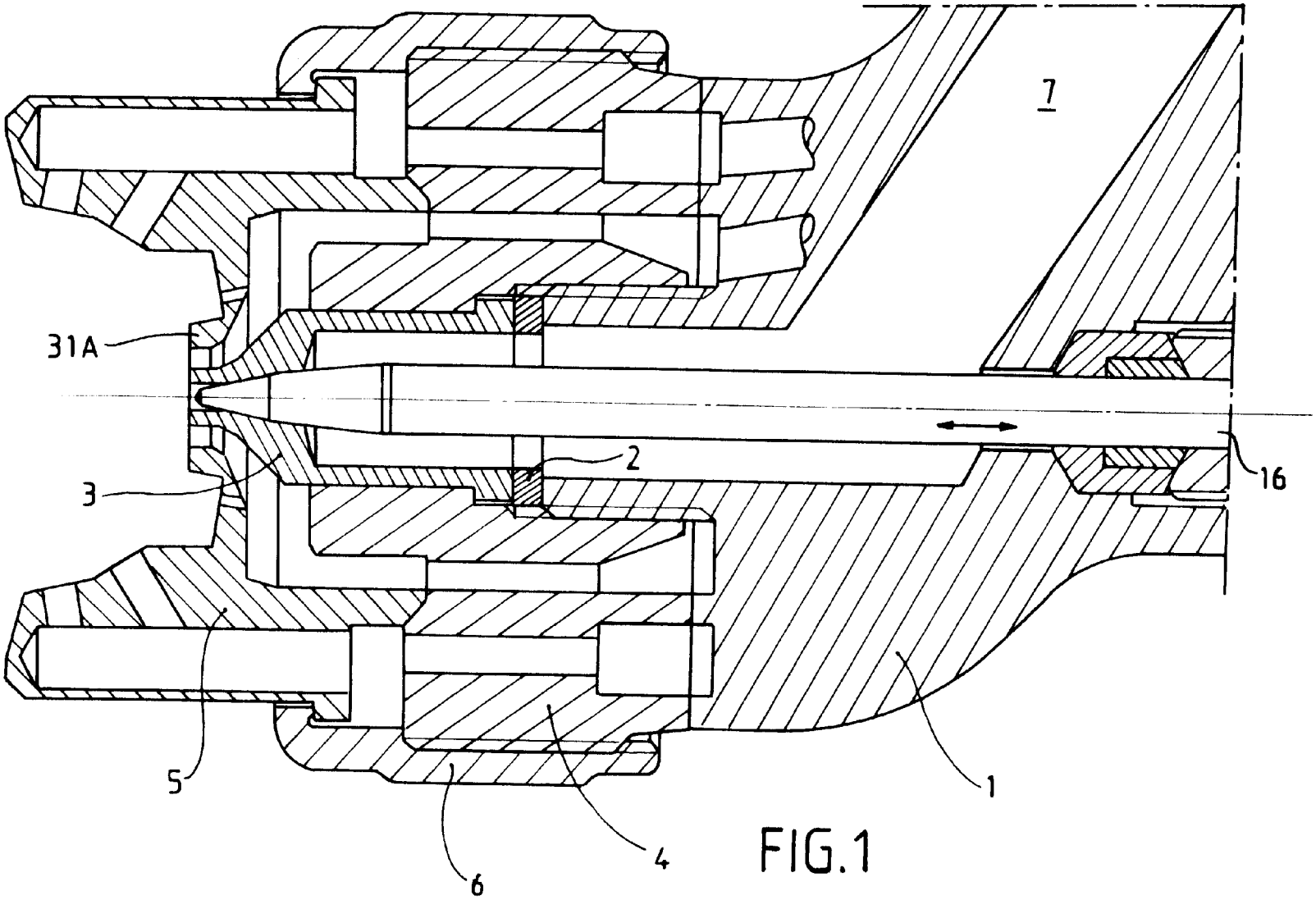
FIG. 1 is a large-scale view in axial section of a spray head of the present invention.
Figure 2:
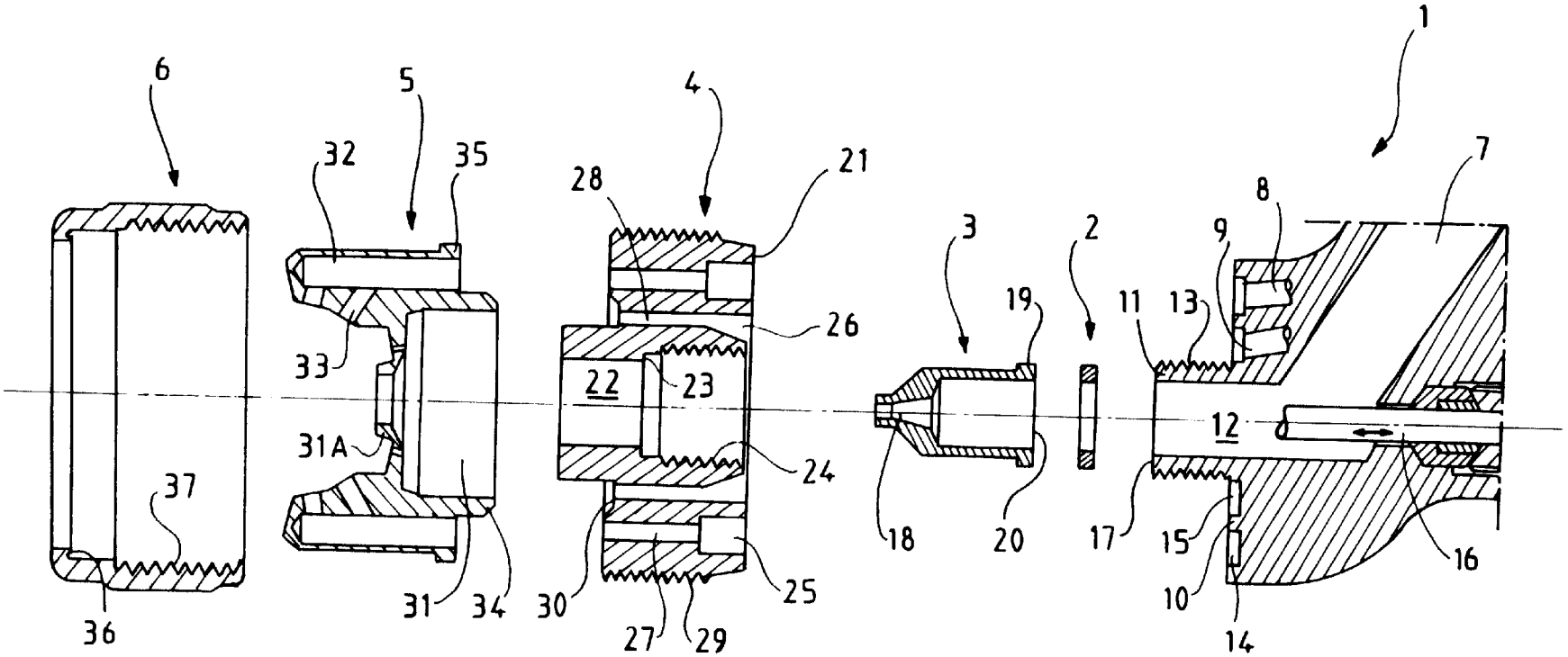
FIG. 2 is an exploded view in axial section and on a smaller scale of the spray head of FIG. 1 and showing the different components of the spray head.

The spray head of the present invention and shown in FIGS. 1 and 2 comprises a body 1, a seal 2, a spray nozzle 3, a gas distribution bush 4, a gas blowing cap-piece 5 and a nut 6.

The body 1 of this spray head comprises an inner conduit 7 feeding the spray substance and two inner conduits 8 and 9 to feed compressed air. The body comprises a planar surface 10 fitted with a tubular Stub 11 of which the inside conduit 12 communicates with the substance feed conduit 7. The outer periphery of the tubular stub 11 bears a thread 13. The conduits 8 and 9 respectively issue into circular recesses 14 and 15 concentric with the tubular stub 11.

A needle 16 is configured coaxially with the tubular stub 11 and is slidingly translatable along its longitudinal axis, as indicated by the double arrow.

The free annular end 17 of the stub 11 is planar and parallel to the planar surface 10 of the body 1. The nozzle 3 is a substantially tubular shape and fitted at one of its ends with a spray orifice 18. At its opposite end the nozzle comprises a shoulder 19 defining a planar annular surface 20.

The seal 2 is inserted between the free annular end 17 of the stub 11 and the planar annular surface 20 of the nozzle 3.

The feed distributing bush 4 comprises a planar end surface 21 which may be pressed against the planar surface 10 of the body 1. Furthermore, the bush 4 comprises a central orifice 22 fitted with a shoulder 23. The nozzle 3 may be inserted at slight friction into the central orifice 22, its shoulder 19 coming to rest against the shoulder 23 of the orifice. The part of the central orifice 22 which is widened by the shoulder 23 bears an inside thread 24 which cooperates with the thread 13 of the stub 11.

Ducts 25 and 26 are present in the bush 4 and issue into the planar surface 21 and are respectively connected to ducts 27 and 28. A thread 29 is present at the periphery of the bush 4. The bush 4 comprises a circular stop 30 opposite the planar surface 21 to come to rest against the gas blowing cap-piece 5.

The gas blowing cap-piece 5 comprises a central chamber 31A fitted with two symmetrical ducts 32 extended by sloping blow ducts 33. Further, a rest surface 34 may be pressed against the surface 30 of the bush 4.

At the side opposite the ducts 33, the blowing cap-piece 5 comprises a shoulder 35 fixable to the cap-piece in the nut 6 fitted with a complementary shoulder 36. The gas distributing bush 4 can be inserted into the nut 6 and comprises an inside thread 37 able to cooperate with the peripheral outer thread 29 of the gas distributing bush 4.

In light of the above discussions, it is understood that by screwing the gas distribution bush 4 on the tubular stub 11 (thanks to the cooperation between the threads 13 and 24), it is simultaneously possible, as follows, to:

affix the spray nozzle 3 in the extension of the tubular stub 11 with insertion of the seal 2 between the planar surfaces 17 and 20, the nozzle being configured in the central orifice 22 and pressed toward the body 1 by the cooperation between the shoulder 19 and 23, and force the planar end surface 21 of the bush 4 against the planar surface 10 of the body 1, the recesses 14 and 15 then being respectively opposite the ducts 25 and 26.

The blowing cap-piece 5 can be affixed to the bush 4 by means of the nut 6 and the mutual action of the threads 29 and 37, the cap-piece 5 being enclosed by the nut and pressed by its rest surface 34 against the stop surface 30 of the stop 4 due to the cooperating shoulders 35 and 36. In the final assembly position, the ducts 27 will be opposite the ducts 32 and; therefore, will be communicating with the blow ducts 33 whereas the ducts 28 will issue into the central chamber 31 of which the blow orifice 31A encloses the spray orifice 18 of the nozzle 3.

In this manner the pressurized gas fed through the conduit 9 is able to propel the spray fed through the conduit 7, and the gas fed through the conduit 8 is able to control the cross-substance section of the jet of tie substance at the exit of the orifice 18.

Accordingly the present invention offers an easily cleaned, easily assembled or disassembled spray head, the seal 2 separating the pressurized gas circuits from the circuit of the substance to be sprayed.

What is claimed is:

1. A spray head for a paint or lacquer sprayer, comprising:

a body having a feed conduit fitted into said body, said body (1) comprises a surface (10) into which a sprayable substance issues from said feed conduit (7);

a tubular spray nozzle (3) affixed to said body and fed with said substance to be sprayed from said feed conduit (7), said nozzle comprising a spray orifice (18) at one end thereof of which the opening and closing are controlled by a displaceable needle (16), said nozzle (3) comprises an annular surface (20) at a side opposite said spray orifice (18);

a seal (2) placed between annular surface (20) and a free end (17) of said feed conduit (7);

a gas-blowing cap-piece (5), and a gas distributing bush (4) fed with pressurized gas from at least one gas feed conduit (8,9) present in said body (1) for feeding gas to said cap-piece (5) in a homogeneous manner at the exit of said spray orifice (18), said gas distributing bush (4) comprises an end surface (21), and guides and keeps in place said nozzle (3); and clamping mechanisms (13,24) to simultaneously compress said end surface (21) of said distributing bush (4) and said surface (10) of said body (1) against each other, and to press said seal (2) between said annular surface (20) of said nozzle (3) and the free end (17) of said feed conduit (7).

2. The spray head as claimed in claim 1, further comprising:

said surface (10) of said body (1) being fitted with a tubular stub (11) into which issues said feed conduit (7), the free annular end of said stub (11) being planar and parallel to said surface (10) of said body (1) and constituting the free end (17) of said feed conduit, and said gas distributing bush (4) having a continuous central orifice (22) inside guiding and keeping in place said nozzle (3), and said distribution bush (4) is mountable on said tubular stub (11).

3. The spray head as claimed in claim 2, wherein said clamping mechanisms are cooperating threads (13, 24) on the tubular stub (11) of said body (1) and in said central orifice (22) of said central distribution bush (4).

4. The spray head as claimed in claim 3, wherein said gas-feed conduit (8,9) issues into a circular recess (14,15) in said surface (10) of said body (1) concentric with said tubular stub (11), said end surface (21) of said gas distributing bush (4) is fitted with a circular duct (25,26) concentric with said central orifice (22), and said circular recess of said body (1) and said circular duct of said distributing bush (4) communicate with each other when said surface (10) of said body and said end surface (21) of said distributing bush are forced against each other.

5. The spray head as claimed in claim 1, wherein said gas blowing cap-piece (5) is detachably but rigidly affixed to said gas distributing bush (4).

6. The spray head as claimed in claim 5, wherein said gas blowing cap-piece (5) is mounted on said gas distributing bush (4) by a nut (6) cooperating with a thread (29) on the outer periphery of said gas distributing bush.

7. The spray head as claimed in claim 1, wherein said body (1) is integral with said sprayer.

8. The spray head as claimed in claim 1, wherein said spray head is mounted on said sprayer.

9. The spray head as claimed in claim 1, wherein said gas distributing bush fed with pressurized gas from at least one gas feed conduit present in said body distributes the gas in such a way as to vary the jet cross-section of said substance at the exit of said spray orifice.

10. The spray head as claimed in claim 1, wherein said body surface into which a sprayable substance issues from said feed conduit is a planar surface.

11. The spray head as claimed in claim 1, wherein said nozzle annular surface at a side opposite said spray orifice is a planar surface.

12. The spray head as claimed in claim 1, wherein said gas distributing bush end surface is a planar surface.

* * * * *